US007661791B2

(12) United States Patent
James, III et al.

(10) Patent No.: US 7,661,791 B2
(45) Date of Patent: Feb. 16, 2010

(54) APPARATUS AND METHOD FOR PERFORMING MECHANICAL PRINTHEAD ALIGNMENT IN AN IMAGING APPARATUS

(75) Inventors: Edmund Hulin James, III, Lexington, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 801 days.

(21) Appl. No.: 10/881,764

(22) Filed: Jun. 30, 2004

(65) Prior Publication Data

US 2006/0001699 A1 Jan. 5, 2006

(51) Int. Cl.

| | |
|---|---|
| ***B41J 2/14*** | (2006.01) |
| ***B41J 29/393*** | (2006.01) |
| ***B41J 23/00*** | (2006.01) |
| ***B41B 15/00*** | (2006.01) |

(52) U.S. Cl. ..... 347/49; 347/19; 347/37; 358/1.9

(58) Field of Classification Search ..... 347/8, 347/49, 37, 38, 41, 42

See application file for complete search history.

(56) References Cited

U.S. PATENT DOCUMENTS

| | | | | |
|---|---|---|---|---|
| 5,241,325 | A | 8/1993 | Nguyen | |
| 5,581,284 | A * | 12/1996 | Hermanson | 347/43 |
| 5,696,541 | A | 12/1997 | Akahane et al. | |
| 6,161,914 | A * | 12/2000 | Haselby | 347/19 |
| 6,244,688 | B1 | 6/2001 | Hickman | |
| 6,270,184 | B1 | 8/2001 | Igarashi et al. | |
| 6,297,888 | B1 * | 10/2001 | Noyes et al. | 347/37 |
| 6,386,681 | B1 * | 5/2002 | Askren et al. | 347/49 |
| 6,450,612 | B2 * | 9/2002 | Igarashi et al. | 347/37 |
| 6,457,800 | B1 | 10/2002 | Bohm et al. | |
| 6,554,398 | B2 | 4/2003 | Wyngaert et al. | |
| 6,568,782 | B1 | 5/2003 | Haselby | |
| 6,629,747 | B1 * | 10/2003 | King et al. | 347/19 |
| 6,637,854 | B2 | 10/2003 | Serra et al. | |
| 6,644,765 | B2 | 11/2003 | Lim | |
| 6,672,707 | B2 | 1/2004 | Silverbrook | |
| 6,773,086 | B2 * | 8/2004 | Serra et al. | 347/12 |
| 7,185,885 | B2 * | 3/2007 | Chelvayohan | 271/110 |
| 2002/0126169 | A1 * | 9/2002 | Wyngaert et al. | 347/12 |
| 2003/0107610 | A1 * | 6/2003 | Lim | 347/8 |
| 2003/0128254 | A1 | 7/2003 | Ison et al. | |

OTHER PUBLICATIONS

Webster's Ninth New Collegiate Dictionary, copyright 1990, Merriam-Webster publishers, Ninth edition, p. 686.*

* cited by examiner

*Primary Examiner*—Matthew Luu
*Assistant Examiner*—Lisa M Solomon

(57) ABSTRACT

An imaging apparatus includes a printhead carrier configured for mounting a printhead cartridge and a cam rotatably coupled to the printhead carrier, the cam having a cam surface positioned opposite the datum pad, the cam surface being positioned for direct contact with the datum pad. A rotation of the cam causes the cam surface to translate the printhead along the media feed direction.

4 Claims, 11 Drawing Sheets

APPARATUS AND METHOD FOR PERFORMING MECHANICAL PRINTHEAD ALIGNMENT IN AN IMAGING APPARATUS

BACKGROUND OF THE INVENTION

1. Field of the Invention

The present invention relates to an imaging apparatus, and, more particularly, to an apparatus and method for performing mechanical printhead alignment in an imaging apparatus.

2. Description of the Related Art

An imaging apparatus, in the form of an ink jet printer, forms an image on a print medium by ejecting ink from a plurality of ink jetting nozzles of an ink jet printhead to form a pattern of ink dots on the print medium. Such an ink jet printer typically includes a reciprocating printhead carrier that transports one or more ink jet printheads across the print medium along a bi-directional scanning path defining a print zone of the printer.

When printing with multiple color printheads or a color and photo printhead, the printheads must be aligned in both the scan and media feed directions for optimal print quality. In particular, printhead alignment in the media feed direction may be difficult to achieve. Manufacturing variation between any two given printheads often results in unacceptable variations in printhead relative location in the media feed direction. Some adjustment of the printheads in the media feed direction can be performed by the imaging data formatter of the imaging apparatus. For example, in an imaging apparatus using staggered printheads each having a nozzle spacing of 1/600 inch, the formatter can effectively align the printheads in increments of one nozzle spacing. That is, knowing the location of the respective swaths, the formatter can adjust which nozzles are used, turning off those nozzles which are overlapping or by alternating use of the overlapped nozzles between the two printheads.

A finer adjustment of 1/1200 inch or less is required for optimum print quality, since the maximum distance that drops of like size can be misaligned in such an imaging apparatus is 1/1200 inch. However, such an adjustment cannot be performed by the formatter, since the nozzle misalignment is less than the nozzle spacing, e.g., less than 1/600 inch in the example given, and hence, a physical movement of a printhead along the media feed direction is required, as opposed to the logical movement performed by the formatter. If a printer does not fire the print heads simultaneously, then the formatter and paper feed rate adjustments can be used to compensate for y-axis (media feed direction) alignment. In the case where the print heads are fired simultaneously, such a physical movement of the printhead is needed.

What is needed in the art is an apparatus and method for performing mechanical printhead alignment in an imaging apparatus along the media feed direction.

SUMMARY OF THE INVENTION

The present invention provides an apparatus and method for performing mechanical printhead alignment in an imaging apparatus along a media feed direction.

The invention, in one form thereof, relates to an imaging apparatus for printing with a printhead cartridge having a printhead. The printhead cartridge has a datum pad facing in a media feed direction. The imaging apparatus includes a printhead carrier configured for mounting the printhead cartridge, and a cam rotatably coupled to the printhead carrier. The cam has a cam surface positioned opposite the datum pad, and the cam surface being positioned for direct contact with the datum pad. A rotation of the cam causes the cam surface to translate the printhead along the media feed direction.

The invention, in another form thereof, relates to an imaging apparatus for printing with a printhead cartridge having a printhead. The printhead cartridge has a datum pad facing in a media feed direction. The imaging apparatus includes a printhead carrier configured for mounting the printhead cartridge, and a ratchet mechanism. The ratchet mechanism includes a toothed member movably disposed in the printhead carrier and having a cam surface coupled to the datum pad, a plunger movably disposed in the printhead carrier, and a plunger dog pivotally coupled to the plunger. The plunger dog has a pawl configured to engage the toothed member. A movement of the plunger causes the pawl to engage and move the toothed member to thereby translate the printhead along the media feed direction via the cam surface.

The invention, in yet another form thereof, relates to a method for performing an alignment of a first printhead relative to a second printhead in an imaging apparatus along a media feed direction. The method includes sensing a misalignment of the printhead relative to the second printhead, the first printhead and the second printhead being mounted in a printhead carrier of the imaging apparatus; determining a mechanical adjustment of a position of the first printhead relative to the second printhead based on the misalignment; and directing a user to make the mechanical adjustment based on the misalignment.

The invention, in still another form thereof, relates to a method for performing an alignment of a first printhead relative to a second printhead in an imaging apparatus along a media feed direction. The method includes sensing a misalignment of the first printhead relative to the second printhead of the imaging apparatus, the first printhead and the second printhead being mounted in a printhead carrier of the imaging apparatus; sensing a misalignment of the first printhead relative to the second printhead of the imaging apparatus, determining a mechanical adjustment of a position of the first printhead relative to the second printhead based on the misalignment; and reciprocating the printhead carrier in a main scan direction to make the mechanical adjustment to thereby effect the alignment of the first printhead and the second printhead in the media feed direction.

An advantage of the present invention is the ability to make a mechanical adjustment to align a printhead with another printhead in an imaging apparatus in a media feed direction to improve print quality.

Another advantage is that the mechanical adjustment may be performed without human intervention.

Another advantage is that the alignment may be performed in increments of less than one pel (the distance between the centers of two vertically adjacent printhead nozzles), for example, ½ pel or ¼ pel.

Yet another advantage is reducing undesirable horizontal banding, grain, and other defects related to dot misalignment, in the printed output of the imaging apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate respective embodiments of the invention, and such exemplifications are not to be construed as limiting the scope of the invention in any manner.

DETAILED DESCRIPTION OF THE INVENTION

Figure 1:
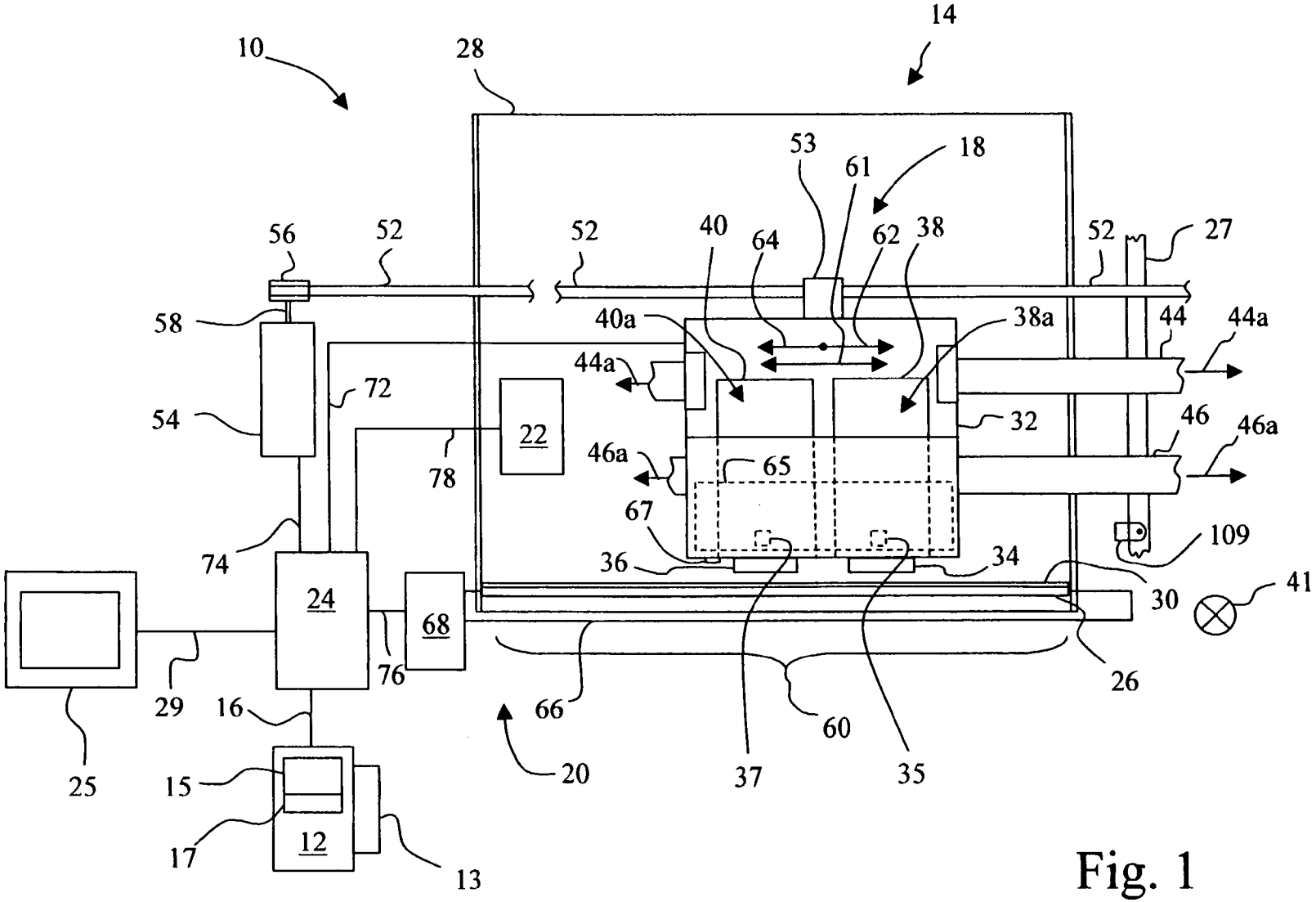
FIG. 1 is a diagrammatic representation of an imaging system embodying the present invention.

Referring now to the drawings, and particularly to FIG. 1, there is shown an imaging system 10 embodying the present invention. Imaging system 10 may include a host 12, or alternatively, imaging system may be a standalone system.

Imaging system 10 includes an imaging apparatus 14, which may be in the form of an ink jet printer 14 as shown. Thus, for example, ink jet printer 14 may be a conventional ink jet printer, or may form the print engine for a multi-function apparatus, such as for example, a standalone unit that has faxing and copying capability, in addition to printing.

Host 12, which may be optional, may be communicatively coupled to ink jet printer 14 via a communications link 16. Communications link 16 may be, for example, a direct electrical connection, a wireless connection, or a network connection.

In embodiments including host 12, host 12 may be, for example, a personal computer including a display device, such as display monitor 13, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver 15 for imaging apparatus 14. Printer driver 15 is in communication with imaging apparatus 14 via communications link 16. Printer driver 15 includes a data formatter 17 that places print data and print commands in a format that can be recognized by imaging apparatus 14, and a halftoning unit. In a network environment, communications between host 12 and imaging apparatus 14 may be facilitated via a standard communication protocol, such as the Network Printer Alliance Protocol (NPAP).

Ink jet printer 14 includes a printhead carrier system 18, a feed roller unit 20, a sheet picking unit 22, a controller 24, a display 25, a mid-frame 26, a side frame 27, and a media source 28.

Display 25 is connected to controller 24 via a communications link 29.

Media source 28 is configured to receive a plurality of print media sheets from which a print medium, e.g., a print media sheet 30, is picked by sheet picking unit 22 and transported to feed roller unit 20, which in turn further transports print media sheet 30 during a printing operation. Print media sheet 30 can be, for example, plain paper, coated paper, photo paper or transparency media.

Printhead carrier system 18 includes a printhead carrier 32 for mounting and carrying, for example, a standard color printhead 34 having an associated printhead datum pad 35, and a photo printhead 36 having an associated datum pad 37, or alternatively a monochrome printhead. A standard color ink reservoir 38 is provided in fluid communication with standard color printhead 34, and a photo ink reservoir 40, or alternatively a monochrome ink reservoir, is provided in fluid communication with photo printhead 36. Those skilled in the art will recognize that standard color printhead 34 and standard color ink reservoir 38 may be formed as individual discrete units, or may be combined as an integral unitary printhead cartridge 38*a*. Likewise, photo printhead 36 and photo ink reservoir 40 may be formed as individual discrete units, or may be combined as an integral unitary printhead cartridge 40*a*. Accordingly, printhead datum pad 35 may be formed on standard color ink reservoir 38 of printhead cartridge 38*a*. Likewise, datum pad 37 may be formed on photo ink reservoir 40 of printhead cartridge 40*a*. Although standard color printhead 34 and photo printhead 36 are employed in the embodiment described, it will be understood that any combination of two or more printheads of the same or different colors may be employed without departing from the scope of the present invention.

Each of printhead datum pad 35 and datum pad 37 provide a reference surface for accurately positioning standard color printhead 34 and photo printhead 36, respectively, in a media feed direction 41, also referred to as the y-axis, designated as an X in a circle to indicate that media feed direction 41 is perpendicular to the plane of FIG. 1. Accordingly, in the each of printhead datum pad 35 and datum pad 37 are facing in media feed direction 41. Media feed direction 41 includes forward feed direction 41*a* and a reverse feed direction 41*b*. In the embodiment shown, both printhead datum pad 35 and datum pad 37 are facing in reverse feed direction 41*b*.

As shown in FIG. 1, printhead carrier 32 is guided by a guide rod 44 and a guide member 46. Each of guide rod 44 and guide member 46 includes a respective horizontal axis 44*a*, 46*a*. The horizontal axis 44*a* of guide rod 44, also sometimes referred to herein as a scan axis 44*a* or X-axis 44*a*, generally defines a bi-directional scanning path for printhead carrier 32. Accordingly, the bi-directional scanning path is associated with each of printheads 34, 36.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is translated in a reciprocating manner along guide rod 44 and guide member 46. Carrier motor 54 can be, for example, a direct current (DC) motor or a stepper motor. The reciprocation of printhead carrier 32 transports ink jet printheads 34, 36 across the print media sheet 30, such as paper, along X-axis 44*a* to define a print zone 60 of ink jet printer 14. The reciprocation of printhead carrier 32 occurs in a main scan direction 61 (bi-directional) that is parallel with X-axis 44*a*, and is also commonly referred to as the horizontal direction. Main scan direction 61 includes a left-to-right carrier scan direction 62 and a right-to-left carrier scan direction 64. Generally, during each scan of printhead carrier 32 while printing, the print media sheet 30 is held stationary by feed roller unit 20.

Printhead carrier 32 also includes a media feed direction adjuster 65 configured for aligning standard color printhead 34 and photo printhead 36. Imaging apparatus 14 includes an auto-alignment sensor 67 mounted in printhead carrier 32, for example, on the bottom of printhead carrier 32. Auto-alignment sensor 67 is configured to sense the misalignment of two or more printheads, e.g., standard color printhead 34 and photo printhead 36, in a conventional manner, for example, by sensing an alignment pattern printed by imaging apparatus 14 using standard color printhead 34 and photo printhead 36. Auto-alignment sensor 67 is configured to sense misalignment in both forward feed direction 41*a* and reverse feed direction 41*b* of media feed direction 41.

Mid-frame 26 provides support for print media sheet 30 when print media sheet 30 is in print zone 60, and in part, defines a portion of a print media path of ink jet printer 14.

Feed roller unit 20 includes a feed roller 66 and corresponding index pinch rollers (not shown). Feed roller 66 is driven by a drive unit 68. The index pinch rollers apply a biasing force to hold print media sheet 30 in contact with respective driven feed roller 66. Drive unit 68 includes a drive source, such as a stepper motor, and an associated drive mechanism, such as a gear train or belt/pulley arrangement. Feed roller unit 20 feeds print media sheet 30 in a direction parallel to media feed direction 41. The media feed direction 41 is commonly referred to as the vertical direction, which is perpendicular to the horizontal bi-directional scanning path, and in turn, perpendicular to the horizontal carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on print media sheet 30, such as for example, by selecting the index feed distance of print media sheet 30 along the print media path as conveyed by feed roller 66, controlling the reciprocation of printhead carrier 32, and controlling the operations of printheads 34, 36.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable.

Each of standard color printhead 34 and photo printhead 36 may include at least two sizes of nozzles, for example, large nozzles and small nozzles, or alternatively may include nozzles all of which being of substantially the same size. In order to increase the height of the swath printed by imaging apparatus 14, standard color printhead 34 and photo printhead 36 are arranged in a staggered fashion, in which an overlap in media feed direction 41 of up to twenty nozzles is provided. This overlap ensures that there are no gaps in the swath printed jointly by standard color printhead 34 and photo printhead 36, for example, due to manufacturing tolerances in standard color printhead 34, photo printhead 36, and printhead carrier 32.

In order for imaging apparatus 14 to provide optimal print output, standard color printhead 34 and photo printhead 36 are aligned so that the dots printed by standard color printhead 34 and photo printhead 36 do not have any appreciable effective nozzle overlap in the jointly printed swath. Thus, the swath will include portions printed by standard color printhead 34, portions printed by photo printhead 36, but with any noticeable portion printed by both standard color printhead 34 and photo printhead 36.

Referring now to FIGS. 2A to 2D, the overlap of standard color printhead 34 and photo printhead 36 in media feed direction 41, prior to alignment, is depicted in 4 potential different states as illustrated by columns of large and small dots printed by each of standard color printhead 34 and photo printhead 36. In FIGS. 2A-2D dots printed by standard color printhead 34 are identified with the letter "S", the dots printed by photo printhead 36 are identified with the letter "P", and an effective nozzle overlap area is identified.

Figure 2A:
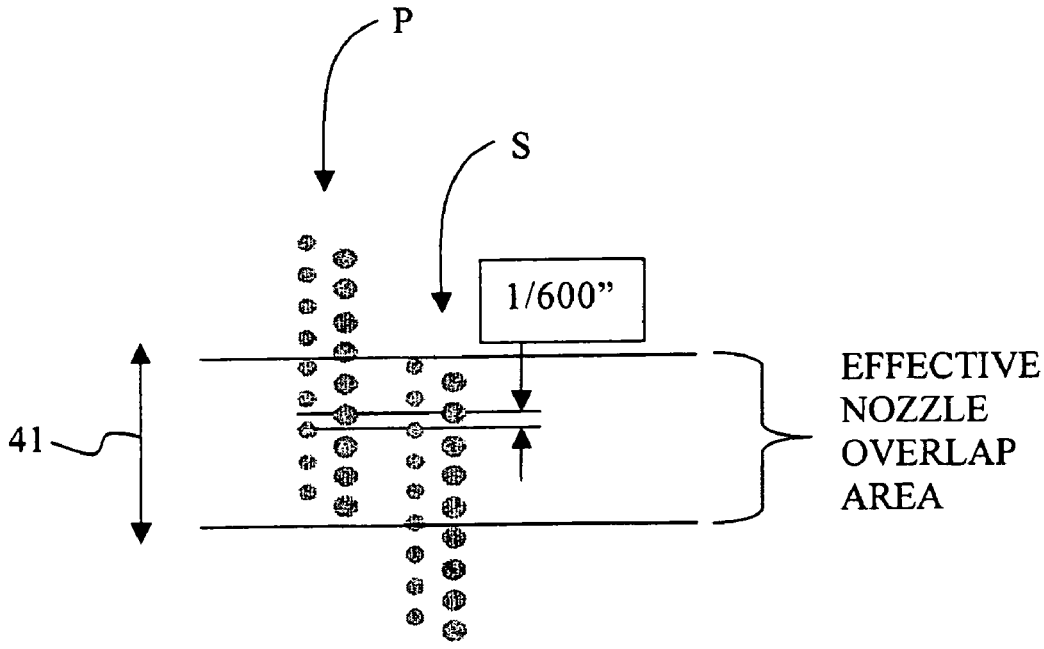
FIGS. 2A-2D depict the overlap of two printheads in a media feed direction in four different exemplary states as illustrated by dots printed by the two printheads.

Referring now to FIG. 2A, it can be seen that the dots printed by each of standard color printhead 34 and photo printhead 36 are lined up vertically. The vertical spacing between the each of the small dots and between each of the large dots is one print element, referred to as a "pel", which measures 1/600 inch in the embodiment shown. A conventional electronic alignment may be performed, for example, using formatter 17 to turn off enough nozzles in either or both of standard color printhead 34 and photo printhead 36 so as to reduce the effective nozzle overlap area to zero. This electronic alignment is also referred to as a logical movement of one or both printheads. That is, although the printheads themselves are not moved, the result of turning off certain nozzles replicates a physical movement of the printheads in that the overlap of printed dots is reduced as if one or both of the printheads were mechanically adjusted, i.e., translated in media feed direction 41.

Because the electronic alignment functions by turning off selected nozzles, however, it only aligns the printheads in increments of nozzle spacing, i.e., one pel, or 1/600 inch, in the present embodiment. However, since the small dots of each printhead line up in main scan direction 61 and the large dots of each printhead line up in main scan direction 61 in the depiction of FIG. 2A, the electronic alignment will be sufficient to eliminate nozzle overlap.

Figure 2B:
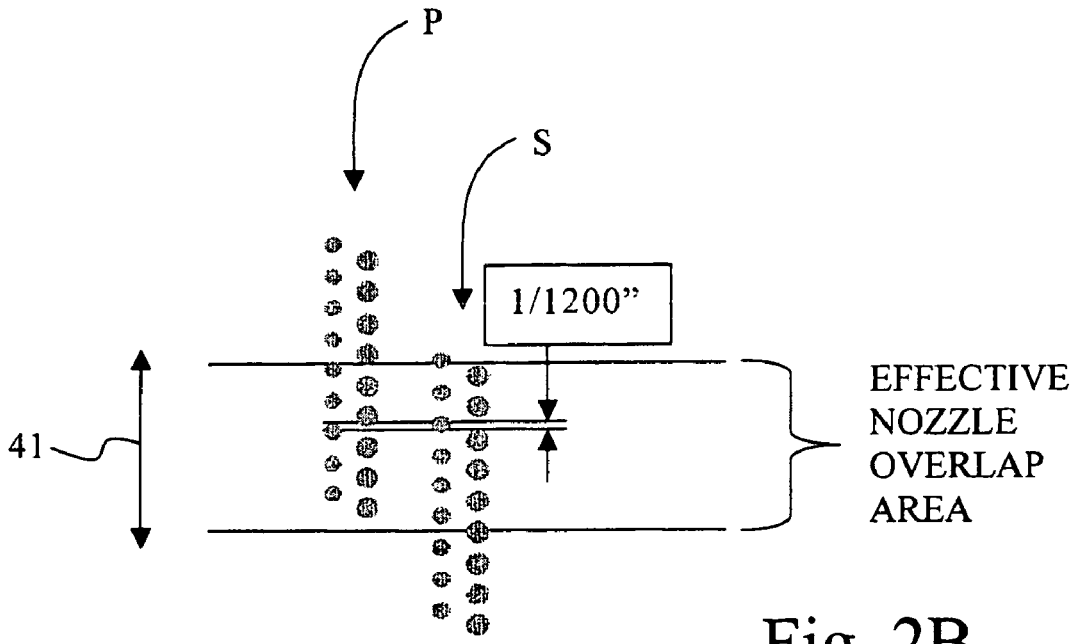

Referring now to FIG. 2B, it is seen that the swaths printed individually by standard color printhead 34 and photo printhead 36 are misaligned by ½ pel, or 1/1200 inch, with swath S shifted upward relative to swath P. However, after performing the electronic alignment, the effective nozzle overlap area will be, for example, 1/1200 inch, since the electronic alignment operates in increments 1 pel, thus removing all overlap except for ½ pel. Such a misalignment will produce undesirable horizontal banding in the output of imaging apparatus 14, although not nearly to the extent as if the electronic alignment was not performed.

Figure 2C:
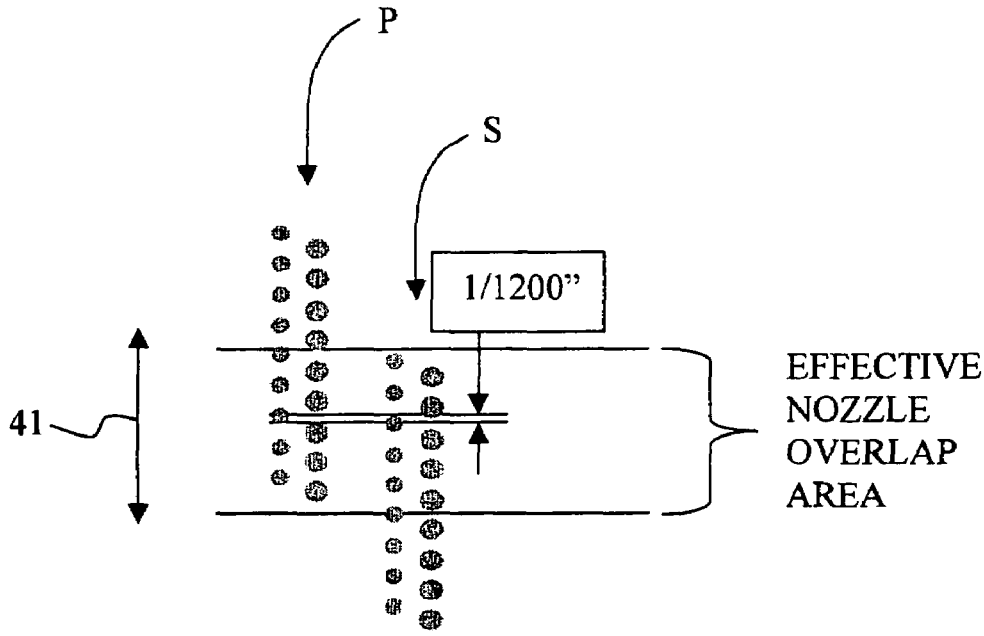

Referring now to FIG. 2C, standard color printhead 34 and photo printhead 36 are misaligned the same amount as in FIG. 2B, except that swath P is shifted upward by ½ pel relative to swath S. As with the misalignment depicted in FIG. 2B, the electronic alignment will only reduce the effective nozzle overlap area to 1/1200 inch, also resulting in horizontal banding.

Figure 2D:
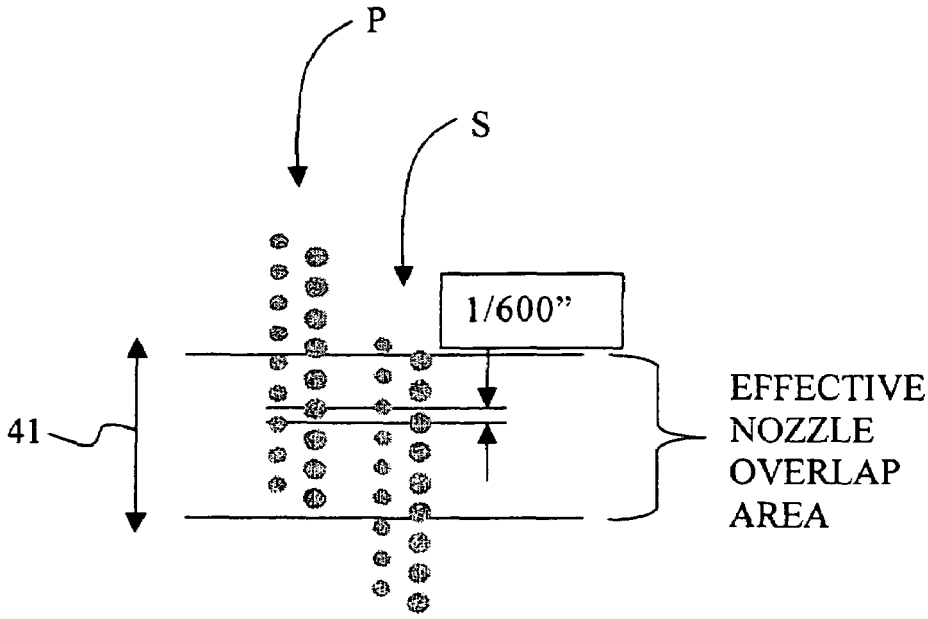

Referring now to FIG. 2D, the alignment of standard color printhead 34 and photo printhead 36 is such that the large nozzles of each printhead line up with the small nozzles of the other. In such a case, assuming that it is desired that small nozzles of one printhead line up with large nozzles of the other printhead, the electronic alignment will sufficient to eliminate all overlap. However, if it is desired that the small nozzles of both printheads line up, the electronic alignment will only be able to reduce the effective nozzle overlap area to 1/600 inch (1 pel).

In order to rectify the misalignment of standard color printhead 34 and photo printhead 36 depicted in FIGS. 2B-2D, a mechanical adjustment that translates standard color printhead 34 with respect to photo printhead 36 in media feed direction 41 is performed using media feed direction adjuster 65 so as to provide alignment in increments of less than one pel.

Figure 3:
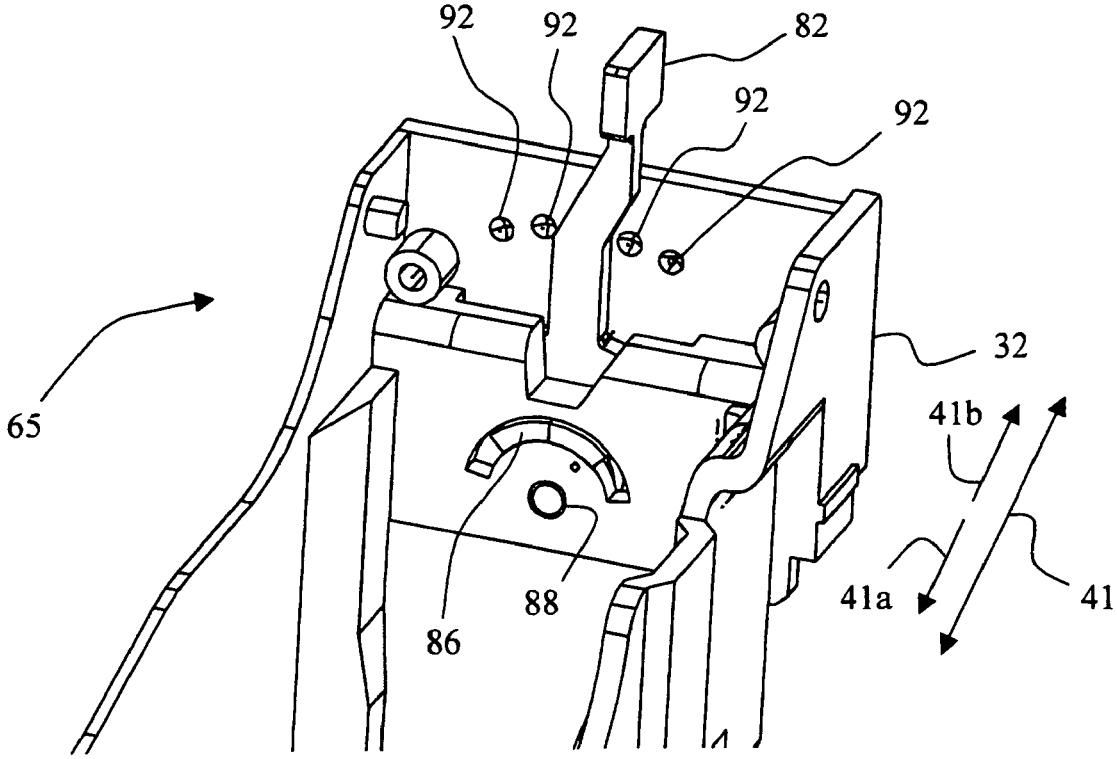
FIG. 3 depicts an embodiment of a printhead position adjuster of the present invention exemplified by the use of a cam and a lever affixed to the cam.
Figure 4:
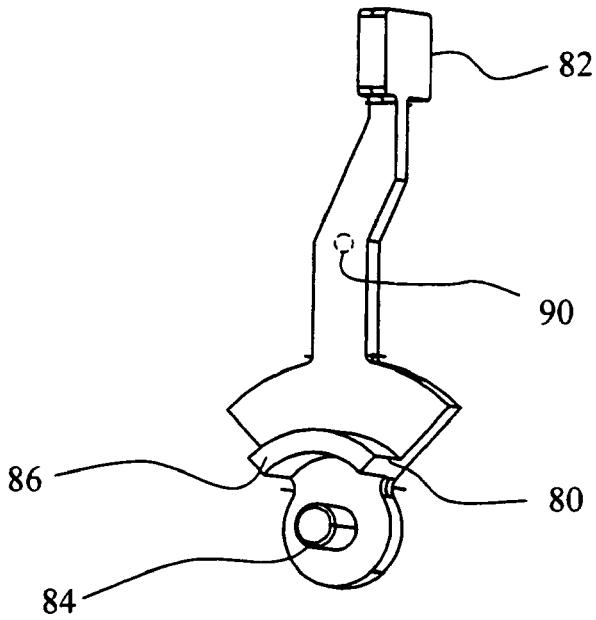
FIG. 4 illustrates the lever and cam of the embodiment of FIG. 3.

Referring now to FIGS. 3 and 4, there is shown an embodiment of imaging apparatus 14 with media feed direction adjuster 65 in accordance with the present invention. In the embodiment of FIGS. 3 and 4, media feed direction adjuster 65 is exemplified via the use of a cam 80 and a lever 82 affixed to cam 80. Cam 80 includes a shaft 84, and has a cam surface 86 positioned opposite printhead datum pad 35. Cam surface 86 is a tapered datum surface, configured for direct contact with printhead datum pad 35, and acts against printhead datum pad 35 in positioning and aligning standard color printhead 34 with photo printhead 36. The term, "cam surface" refers to a surface having a predominantly non-zero slope, which is used to effect a movement, e.g., translation, of a device in contact therewith.

Cam 80 is rotatably coupled to printhead carrier 32 via a hole 88 in printhead carrier 32. Lever 82 includes a projection 90 for engaging any of detent 92 in printhead carrier 32 to retain lever 82 in a desired position. Lever 82 and cam 80 are used to align standard color printhead 34 with photo printhead 36, based on a rotation of cam 80 that causes cam surface 86 to translate standard color printhead 34 in media feed direction 41. In order to accommodate an accurate alignment, controller 24 is configured to execute instructions to direct a user of imaging apparatus 14 via display 25 to move lever 82 by an amount determined based on the misalignment sensed by auto-alignment sensor 67. By performing this mechanical adjustment, the position of standard color printhead 34 in media feed direction 41 is changed relative to that of photo printhead 36 to align standard color printhead 34 with photo printhead 36. The direction of movement of lever 82 determines the direction of translation of standard color printhead 34 in media feed direction 41, for example, forward feed direction 41*a* or reverse feed direction 41*b*.

Figure 5:
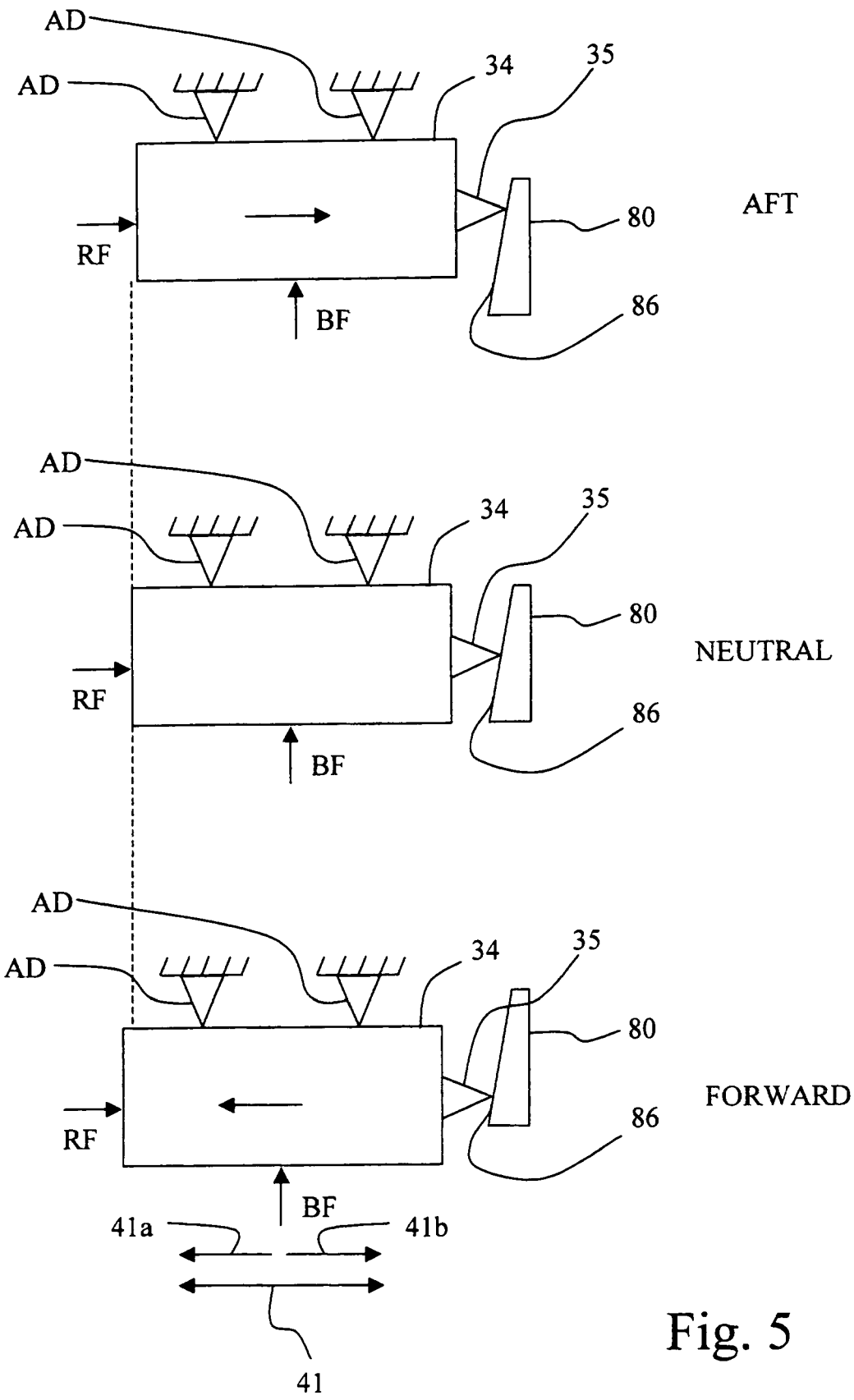
FIG. 5 illustrates an example of the mechanics of adjusting the position of a printhead according to the embodiment of FIG. 3 using simple diagrams.

Referring now to FIG. 5, the mechanics of adjusting the position of standard color printhead 34 in media feed direction 41 is explained in an example using simple diagrams. In FIG. 5, cam 80 with cam surface 86 in the form of a taper is illustrated as a trapezoid, printhead datum pad 35 is illustrated as the indicated triangle, and standard color printhead 34 is illustrated as the rectangular box. The letters, "BF", designate a biasing force that biases standard color printhead 34 against a portions AD of printhead carrier 32, such as datum structures used to maintain an accurate position of standard color printhead 34 in printhead carrier 32 in main scan direction 61. The letters, "RF" designate a restoring force that biases standard color printhead 34 so as to maintain firm contact between printhead datum pad 35 and cam surface 86 of cam 80. The biasing force BF and retaining force RF are typically generated via resilient portions (not shown) of printhead carrier 32 due to spring loaded features or an interference fit of standard color printhead 34 in printhead carrier 32.

The middle diagram in FIG. 5 indicates a neutral position of lever 82 and cam 80 as they are depicted in FIG. 3. A movement of lever 82 in a counter clockwise direction rotates cam 80 such that cam surface 86 is effectively moved upward relative to printhead datum pad 35, resulting in a displacement of standard color printhead 34 in a forward direction, as depicted in the bottom diagram of FIG. 5, overcoming retaining force RF.

Conversely, movement of lever 82 in a clockwise direction rotates cam 80 such that cam surface 86 is effectively moved downward relative to printhead datum pad 35, resulting in retaining force RF causing a displacement of standard color printhead 34 in an aft direction, as depicted in the top diagram of FIG. 5.

It will be understood that the adjustments to standard color printhead 34 are not limited by the exemplification of FIG. 5.

Figure 6:
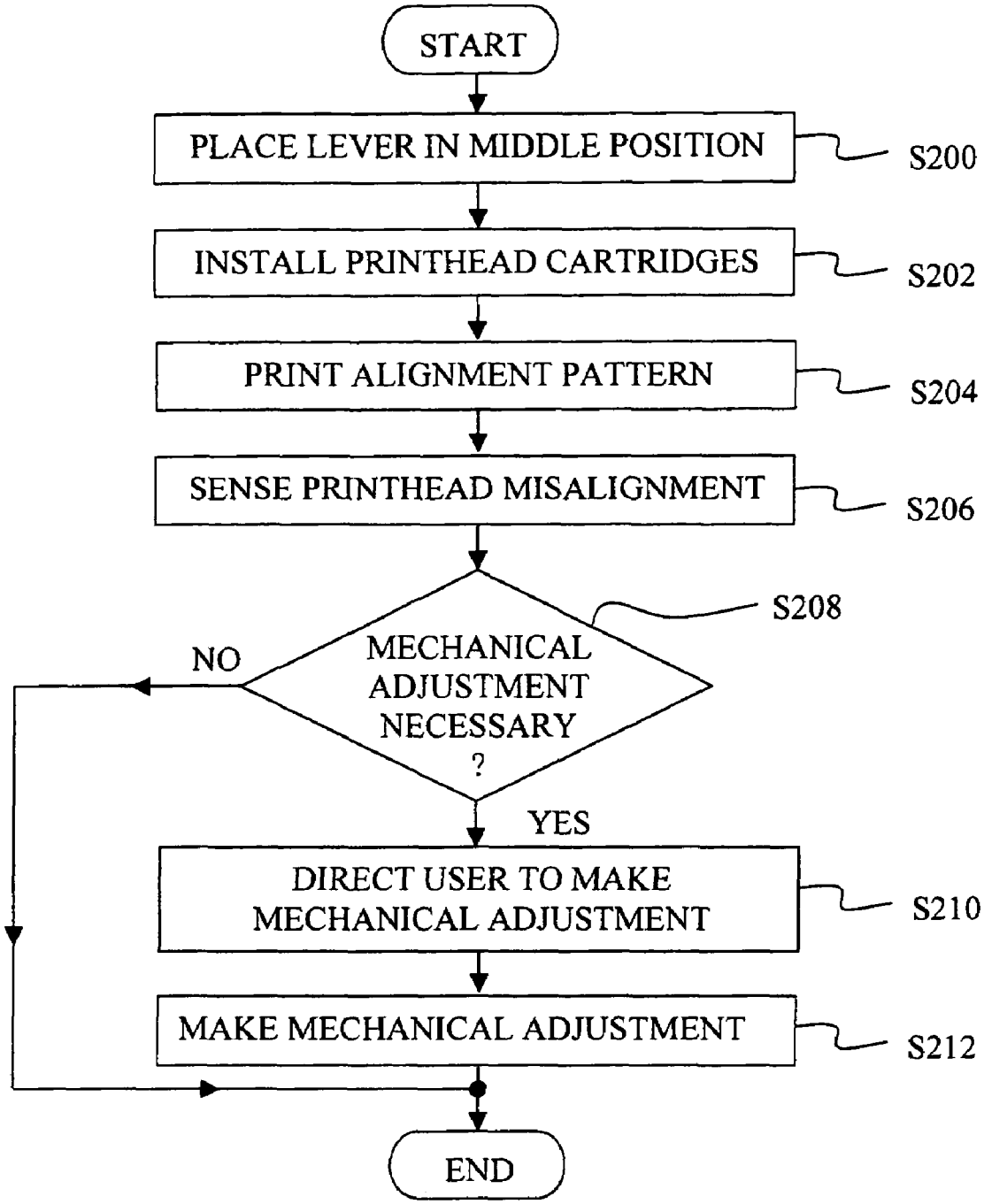
FIG. 6 is a flowchart depicting a method of performing an alignment according to the embodiment of FIG. 3.

Referring now to FIG. 6, an embodiment of method for performing an alignment of standard color printhead 34 with photo printhead 36 in imaging apparatus 14 in media feed direction 41 is depicted.

At step S200 the user of imaging apparatus 14 places lever 82 in the middle position, as depicted in FIG. 2, for example, prior to installing standard color printhead 34 in imaging apparatus 14.

At step S202, the user installs standard color printhead 34 and photo printhead 36 into imaging apparatus 14 by mounting standard color printhead 34 and photo printhead 36 in printhead carrier 32.

At step S204, imaging apparatus 14 automatically prints an alignment pattern (not shown), e.g., as part of a test page automatically printed when any printhead is installed.

At step S206, controller 24 executes instructions to sense a misalignment of standard color printhead 34 relative to photo printhead 36 using auto-alignment sensor 67, based on sensing the alignment pattern.

At step S208, controller 24 executes instructions to determine if a mechanical adjustment of a position of standard color printhead 34 relative to photo printhead 36 is necessary for alignment, based on sensing any misalignment. The mechanical adjustment pertains an adjustment of the position of standard color printhead 34 along media feed direction 41. If a mechanical adjustment is necessary, process flow proceeds to step S210, otherwise the alignment process is completed.

At step S210, imaging apparatus 14 employs controller 24 to execute instructions to direct the user via display 25 to make the mechanical adjustment to standard color printhead 34 based on the misalignment. The mechanical adjustment translates standard color printhead 34 in media feed direction 41 relative to photo printhead 36. The amount and direction of the mechanical adjustment of a position of standard color printhead 34 relative to photo printhead 36 is determined based on sensing the misalignment in step S206. For example, the user may be instructed to move lever 82 backward to engage the next detent 92.

The amount of adjustment between each detent 92 depends on the taper of cam surface 86. In the embodiment shown, the amount of the mechanical adjustment effected by moving lever 82 to engage the next detent is an increment of ½ pel (1/200 inch), although any suitable amount as between each detent 92 may be employed, such as, for example, ¼ pel. Those skilled in the art would appreciate that the increments of mechanical adjustment may easily be varied, for example, by changing the spacing between each detent 92 and or changing the amount of taper of cam surface 86.

Although display 25 is used to provide direction to the user in the present embodiment, it is alternatively contemplated that display monitor 13 of host 12 may be likewise employed.

At step S212, the user makes the mechanical adjustment to effect the alignment by moving lever 82 as indicated by display 25. The movement of lever 82 causes a rotation of cam 80, which causes cam surface 86 to translate standard color printhead 34 in media feed direction 41 relative to photo printhead 36, thus aligning standard color printhead 34. The direction of movement of lever 82 may such as to translate standard color printhead 34 in forward feed direction 41*a* or reverse feed direction 41*b* of media feed direction 41, depending upon the direction of misalignment sensed in step S206.

Figure 7:
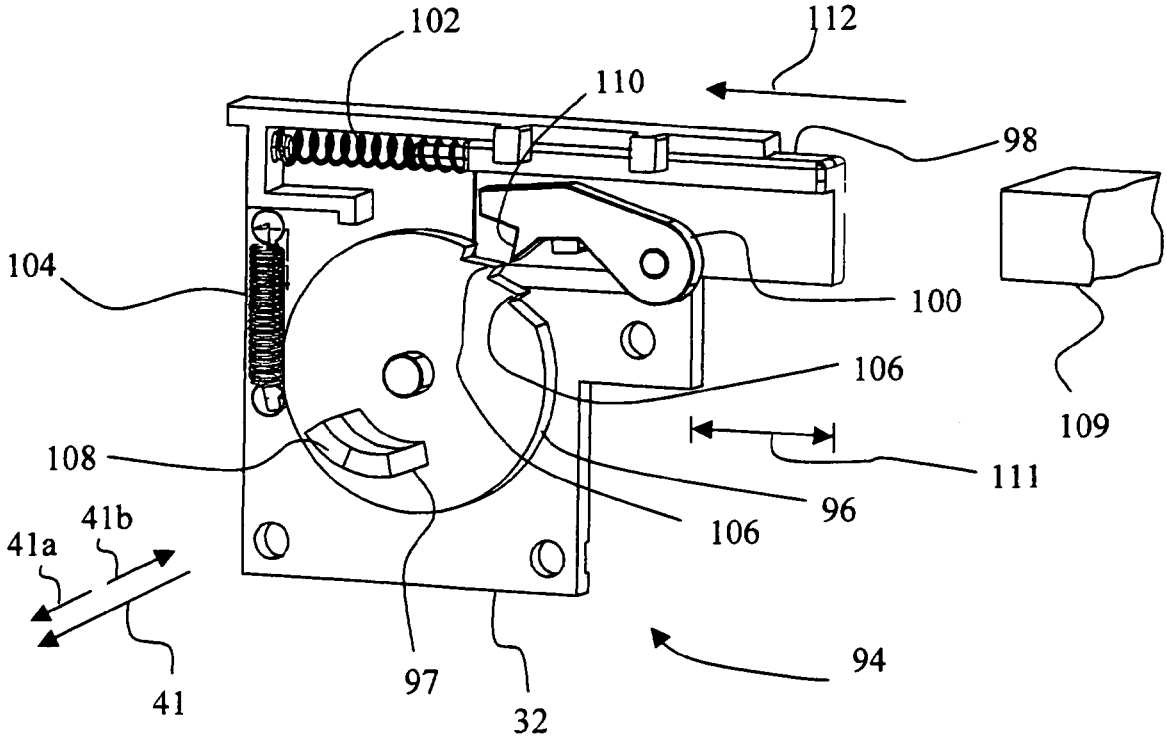
FIG. 7 depicts an embodiment of a printhead position adjuster of the present invention exemplified by a ratchet adjuster having a toothed member including a cam.

Referring now to FIG. 7 another embodiment of the present invention is depicted in which user intervention is not required in order to complete the alignment process, and in which media feed direction adjuster 65 is exemplified via the use of a ratchet mechanism 94.

Ratchet mechanism 94 includes a toothed member 96 having a cam 97, a plunger 98, a plunger dog 100, a plunger return spring 102, and a toothed member return spring 104.

Toothed member 96 includes at least one tooth 106 and a cam surface 108. Toothed member 96 is movably disposed in printhead carrier 32, and cam surface 108 is coupled to printhead datum pad 35, for example, directly contacting printhead datum pad 35. Cam surface 108 is a tapered datum surface, and acts against printhead datum pad 35 in positioning and aligning standard color printhead 34 relative to photo printhead 36. Plunger 98 is movably disposed in printhead carrier 32, and is coupled to plunger return spring 102, which is oppositely coupled to printhead carrier 32. In addition, plunger 98 is positioned on printhead carrier 32 in a location opposite a flag member 109 movably affixed to side frame 27. Plunger dog 100 is pivotally coupled to plunger 98, and has a pawl 110 configured to engage each tooth 106 of toothed member 96.

Ratchet mechanism 94 is configured such that a movement of plunger 98 by a stroke distance 111 in a direction indicated by direction arrow 112 causes pawl 110 to engage and move toothed member 96 into rotation, wherein the taper of cam surface 108 against printhead datum pad 35 of standard color printhead 34 to thereby translate standard color printhead 34 in media feed direction 41, for example, forward feed direction 41*a*. Plunger stroke distance 111 provides a set translation imparted by cam surface 108 to print head datum pad 35. In the embodiment shown, the distance standard color printhead 34 is translated via moving plunger 98 by stroke distance 111 is ½ pel, although any suitable amount, e.g., ¼ pel, may be employed without departing from the scope of the present invention.

It will be appreciated by those skilled in the art that the taper of cam surface 108 may alternatively be configured such that the translation of standard color printhead 34 is in reverse feed direction 41*b*. Similarly, the taper of cam surface 108 may alternatively be a compound taper configured such that the translation of standard color printhead 34 is in forward feed direction 41*a* for a first number of movements of plunger 98 and then is in reverse feed direction 41*b* for a second number of movements of plunger 98, or vice-versa.

Controller 24 is configured to control the reciprocation of printhead carrier 32 based on misalignment sensed by auto-alignment sensor 67, with the reciprocation acting to drive plunger 98 into flag member 109 to cause movement of plunger 98.

Figure 8:
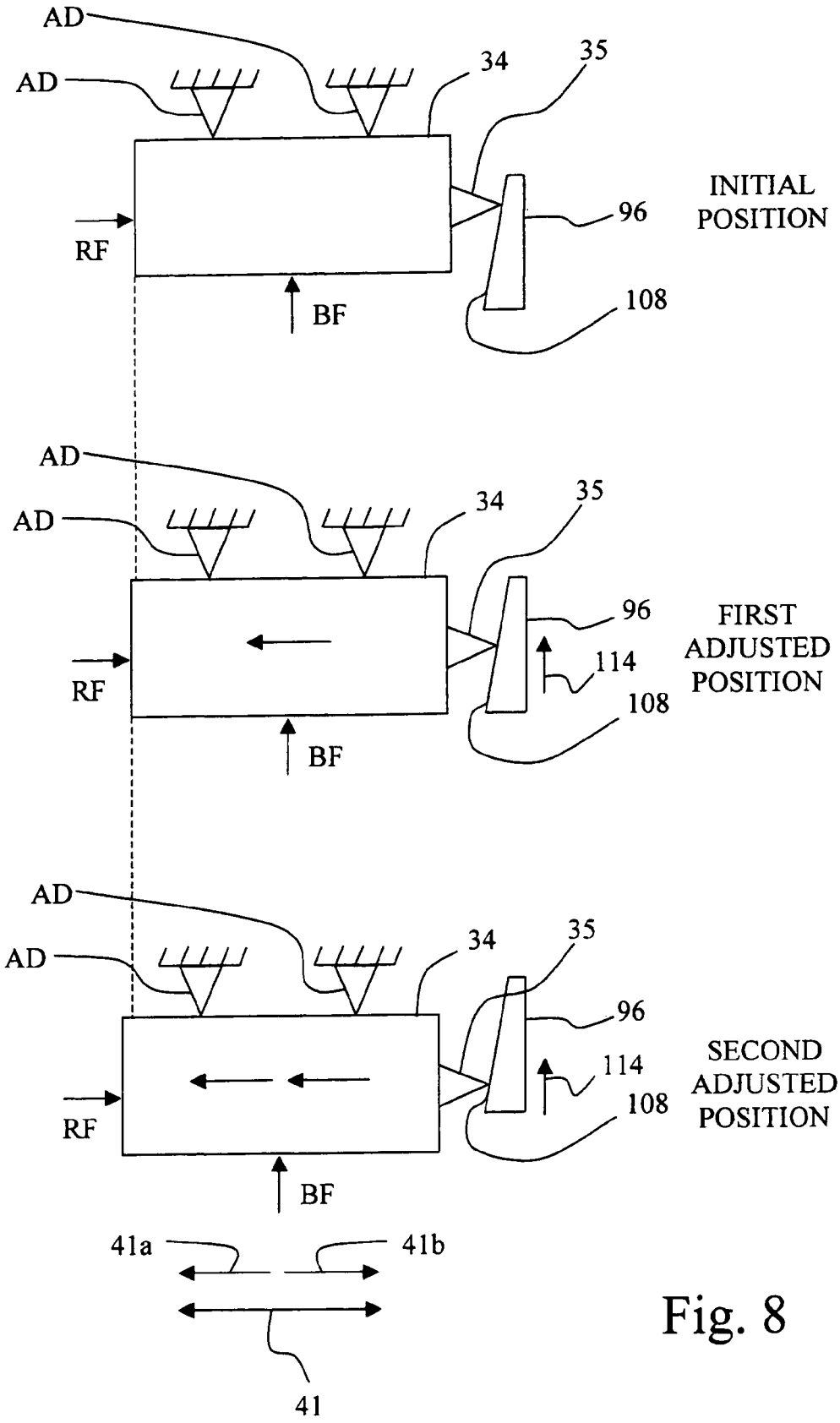
FIG. 8 is illustrates an example of the mechanics of adjusting the position of a printhead according to the embodiment of FIG. 7 using simple diagrams.

Referring now to FIG. 8, the mechanics of adjusting the position of standard color printhead 34 in media feed direction 41 is explained via an example using simple diagrams. In FIG. 8, toothed member 96 with cam surface 108 in the form of a taper is illustrated as a trapezoid, printhead datum pad 35 is illustrated as the indicated triangle, and standard color printhead 34 is illustrated as the rectangular box. The letters, "BF", designate a biasing force that biases standard color printhead 34 against a datum portions AD of printhead carrier 32, such as datum structures used to maintain an accurate position of standard color printhead 34 in printhead carrier 32. The letters, "RF" designate a restoring force that biases standard color printhead 34 so as to maintain firm contact between printhead datum pad 35 and cam surface 108. The biasing force BF and retaining force RF are typically generated via a resilient or semi-resilient portions (not shown) of printhead carrier 32 due to an interference fit of standard color printhead 34 in printhead carrier 32.

The top diagram in FIG. 8 indicates the initial position of standard color printhead 34 and cam surface 108 of toothed member 96 when standard color printhead 34 is installed into printhead carrier 32.

Referring now to FIGS. 7 and 8, a forced movement of plunger 98 in a direction towards printhead carrier 32 and against plunger return spring 102 causes pawl 110 of plunger dog 100 to engage a tooth 106 of toothed member 96, causing a rotation of toothed member 96 in a counter clockwise direction such that cam surface 108 is effectively moved upward relative to printhead datum pad 35 as indicated by direction arrow 114. This results in a translation of standard color printhead 34 in a forward direction to a first adjusted position, as depicted in the middle diagram of FIG. 8, overcoming retaining force RF. It is noted that the motion of cam surface 108 in direction 114 provides a force on standard color printhead 34 in a direction towards contact with datum portions AD of printhead carrier 32, hence preventing any motion of standard color printhead 34 in main scan direction 61.

A subsequent retraction of the force that moved plunger 98 will result in plunger 98 returning to its initial position under the action of plunger return spring 102, but will not result in an opposite translation of standard color printhead 34, because toothed member 96 is held in place by friction between cam surface 108 and printhead datum pad 35. This friction is released only when standard color printhead 34 is removed from printhead 32, at which time toothed member 96 will retract to its initial position under the action of toothed member return spring 104, which is configured to return ratchet mechanism 94 to a home position upon a removal of standard printhead 34 from printhead carrier 32. Thus, ratchet mechanism 94 automatically resets to a starting point, or home position, when standard color printhead 34 is removed from printhead carrier 32 to thereby release the friction forces at print head datum pad 35. Without the friction forces holding toothed member 96 in place, toothed member return spring 104 rotates toothed member 96 and cam 97 backwards against a rotational stop block (not shown) to the home position, thus readying ratchet mechanism 94 for the next printhead insertion and auto-alignment process.

Similarly, another movement of plunger 98 a direction towards printhead carrier 32 will result in an additional translation of standard color printhead 34 in forward feed direction 41*a* to a second adjusted position, as depicted in the bottom diagram of FIG. 8.

It will be understood that the adjustments to standard color printhead 34 are not limited by the exemplification of FIG. 8, but rather, any suitable amounts of adjustment may be made without departing from the scope of the present invention.

Likewise, any suitable number of adjustments may be made without departing from the scope of the present invention.

Figure 9:
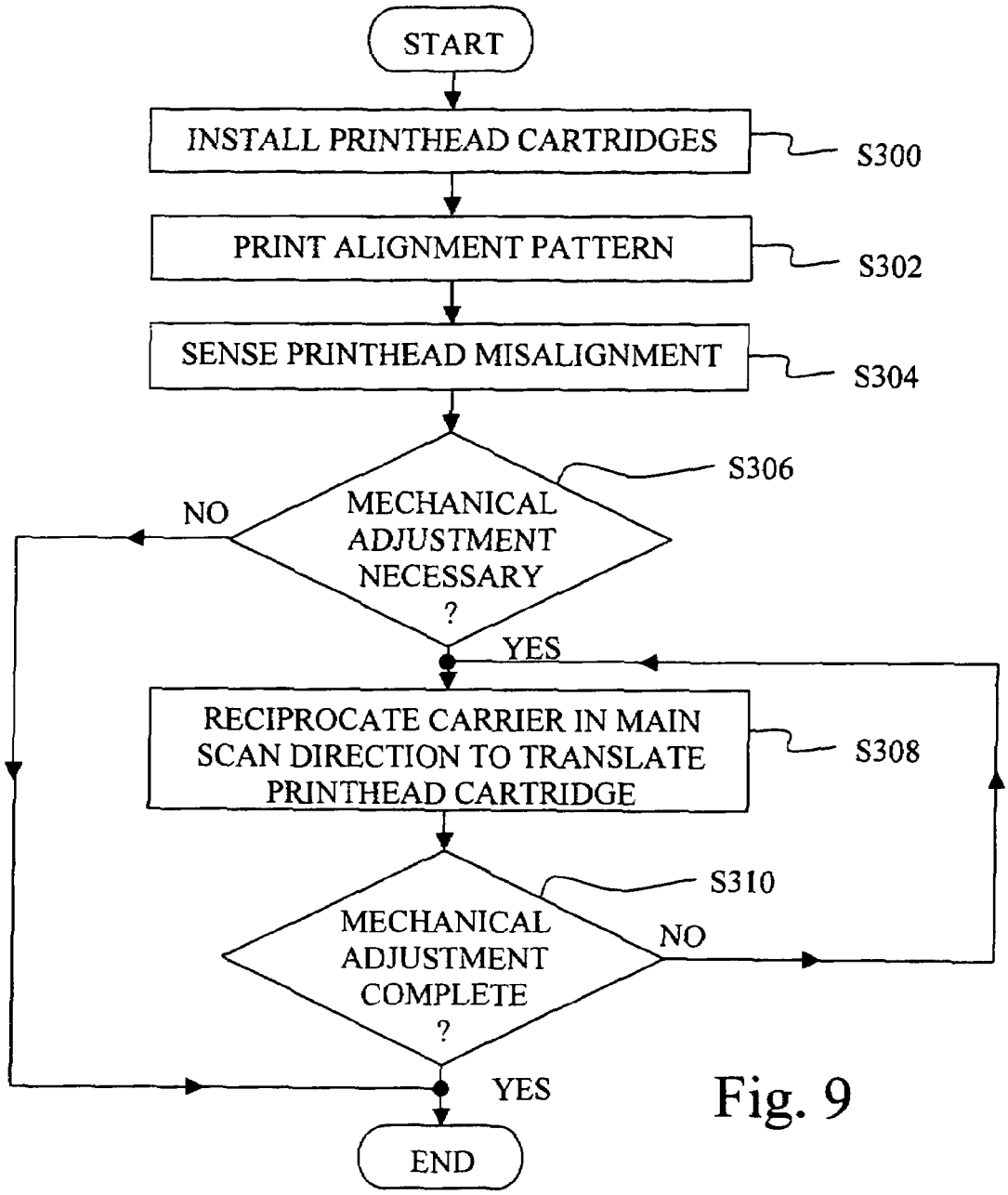
FIG. 9 is a flowchart depicting a method of performing an alignment according to the embodiment of FIG. 7.

Referring now to FIG. 9, another embodiment of method for performing an alignment of a standard color printhead 34 with photo printhead 36 in imaging apparatus 14 in media feed direction 41 is depicted.

At step S300, the user installs standard color printhead 34 and photo printhead 36 into imaging apparatus 14 by mounting standard color printhead 34 and photo printhead 36 in printhead carrier 32.

At step S302, imaging apparatus 14 automatically prints an alignment pattern (not shown), e.g., as part of a test page printed when any printhead is installed.

At step S304, controller 24 executes instructions to sense a misalignment of standard color printhead 34 relative to photo printhead 36 using auto-alignment sensor 67, based on sensing the alignment pattern.

At step S306, controller 24 executes instructions to determine if a mechanical adjustment to standard color printhead 34 is necessary, based on sensing any misalignment in step S304. As such, the amount and direction of a position of standard color printhead 34 relative to a position of photo printhead 36 is determined based on sensing the misalignment in step S304. The mechanical adjustment pertains an adjustment of the position of standard color printhead 34 along media feed direction 41. If so, process flow proceeds to step S308, otherwise the alignment process is completed.

At step S308 controller 24 executes instructions to reciprocate printhead carrier 32 in main scan direction 61 to make the mechanical adjustment so as to effect the alignment of standard color printhead 34 relative to photo printhead 36. The mechanical adjustment translates standard color printhead 34 along media feed direction 41 relative to photo printhead 36.

In the present embodiment, the reciprocation of printhead carrier 32 in main scan direction 61 moves in left-to-right carrier scan direction 62, in order to engage plunger 98 with flag member 109, driving plunger 98 of ratchet mechanism 94 inward with respect to printhead carrier 32 by stroke distance 111, thus translating standard color printhead 34, as set forth above with respect to FIG. 8, relative to photo printhead 36. Printhead carrier 32 then moves in right-to-left carrier scan direction 64, releasing plunger 98 from engagement with flag member 109, at which point plunger 98 returns to its original position under the action of plunger return spring 102.

In the embodiment shown, the amount of the mechanical adjustment effected by each reciprocation of printhead carrier 32 is an increment of ½ pel (1/200 inch), although any suitable amount may be employed, such as, for example, ¼ pel. Those skilled in the art would appreciate that the incremental amount of mechanical adjustment of the present embodiment may easily be varied, for example, by changing stroke 111 of plunger 98 and/or changing the amount of taper of cam surface 108. The amount and direction of translation of standard color printhead 34 is determined based on the misalignment sensed in step S304.

At step S310 controller 24 executes instructions to determine if the mechanical adjustment is complete. If not, the method proceeds back to step S308 for another increment of adjustment, otherwise, the process flow of the present embodiment method ends. For example, if the misalignment of standard color printhead 34 in forward feed direction 41*a* relative to photo printhead 36 was 1 pel, and standard color printhead 34 was translated ½ pel in forward feed direction 41*a* in step S308, further mechanical adjustment is required. In such a case, the method proceeds back to step S308 in order to perform another ½ pel translation of standard color printhead 34 in forward feed direction 41*a*.

It will be understood that the alignment may be rechecked upon completion of step S310 by printing and sensing another alignment test pattern as in steps S302 and S304, respectively, and performing another incremental adjustment if required, without departing from the scope of the present invention.

Figure 10:
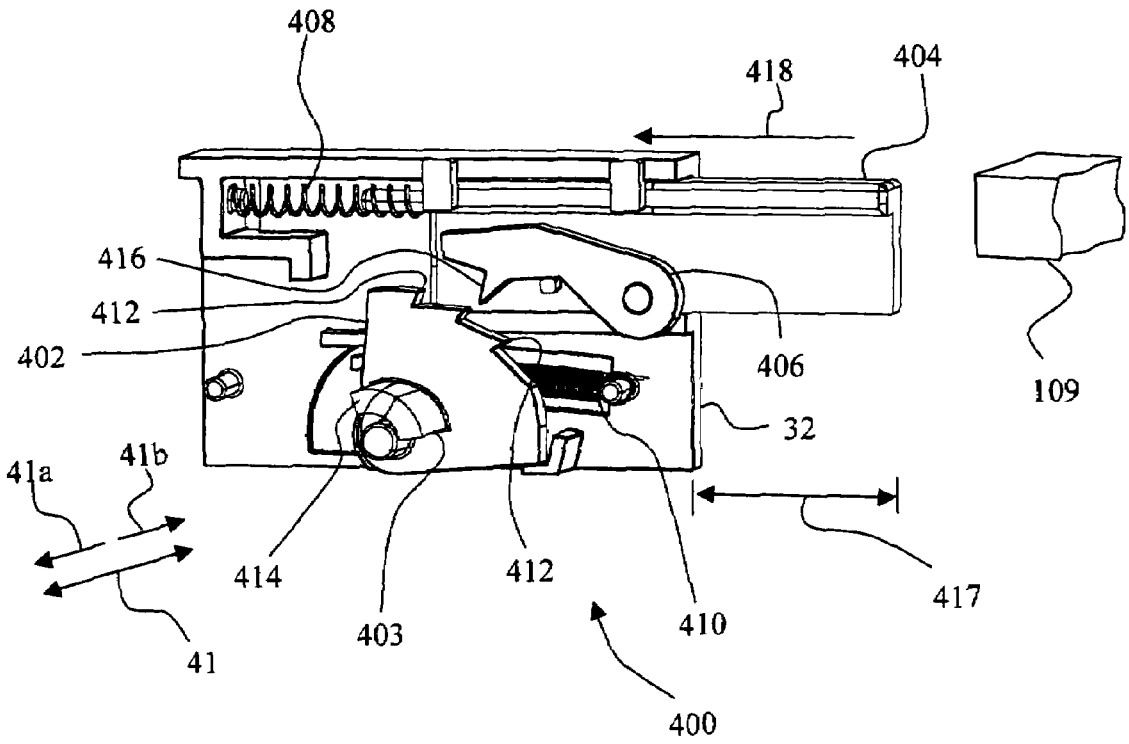
FIG. 10 depicts another embodiment of a media feed direction adjuster of the present invention exemplified by a ratchet adjuster having a toothed member including a cam.

Referring now to FIG. 10, still another embodiment of the present invention is depicted, similar to the embodiment of FIG. 7, in which media feed direction adjuster 65 is exemplified via the use of a ratchet mechanism 400.

Ratchet mechanism 400 includes a toothed member 402 having a cam 403, a plunger 404, a plunger dog 406, a plunger return spring 408, and a toothed member return spring 410.

Toothed member 402 includes at least one tooth 412 and a cam surface 414. Toothed member 402 is movably disposed in printhead carrier 32, and cam surface 414 is coupled to printhead datum pad 35, for example, directly contacting printhead datum pad 35. Cam surface 414 is a tapered datum surface, and acts against printhead datum pad 35 in positioning and aligning standard color printhead 34 with photo printhead 36. Plunger 404 is movably disposed in printhead carrier 32, and is coupled to plunger return spring 408, which is oppositely coupled to printhead carrier 32. In addition, plunger 404 is positioned on printhead carrier 32 in a location opposite flag member 109 affixed to side frame 27. Plunger dog 406 is pivotally coupled to plunger 404, and has a pawl 416 configured to engage each tooth 412 of toothed member 402.

As illustrated in FIG. 10, ratchet mechanism 400 is configured such that a movement of plunger 404 by a stroke distance 417 in a direction indicated by direction arrow 418 causes pawl 416 to engage and move toothed member 402 into rotation, wherein the action of the taper of cam surface 414 acts against printhead datum pad 35 of standard color printhead 34 to thereby translate standard color printhead 34 in media feed direction 41, for example, forward feed direction 41*a*.

It will be appreciated by those skilled in the art that the taper of cam surface 414 may alternatively be configured such that the translation of standard color printhead 34 is in reverse feed direction 41*b*. Similarly, the taper of cam surface 414 may alternatively be a compound taper configured such that the translation of standard color printhead 34 is in forward feed direction 41*a* for a first number of movements of plunger 404 and then is in reverse feed direction 41*b* for a second number of movements of plunger 404, or vice-versa.

Controller 24 is configured to control the reciprocation of printhead carrier 32 based on a misalignment sensed by auto-alignment sensor 67, with the reciprocation of printhead carrier 32 acting to drive plunger 404 into flag member 109 to cause movement of plunger 404.

The method of operation described with respect to FIGS. 7, 8 and 9 applies equally to the embodiment of FIG. 10.

Figure 11:
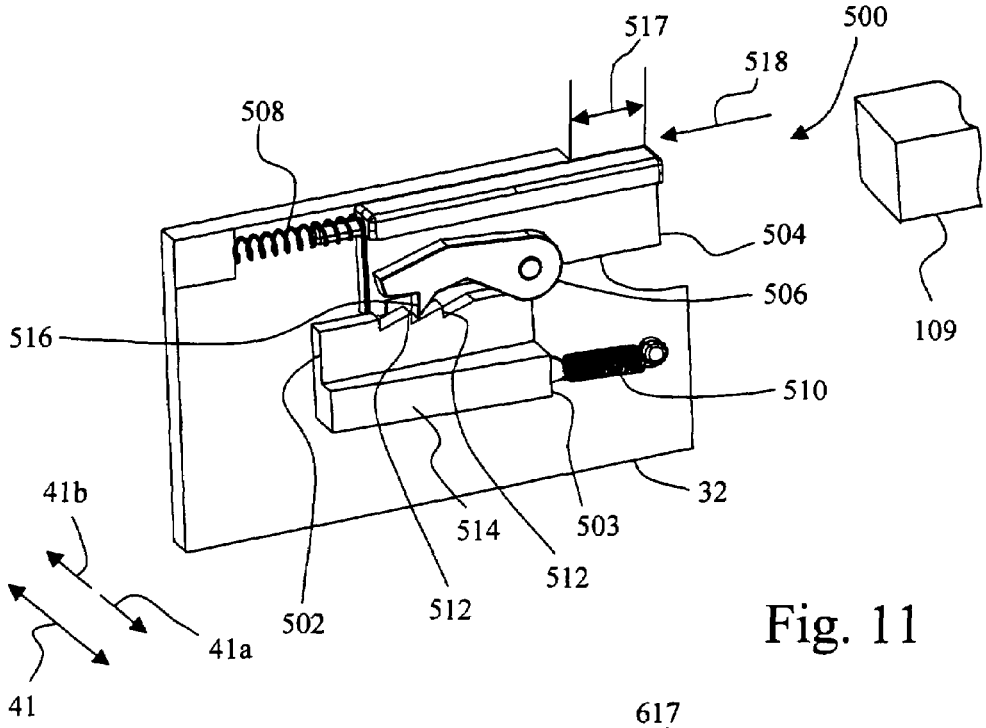
FIG. 11 depicts an embodiment of a media feed direction adjuster of the present invention exemplified by a ratchet adjuster having a toothed member including a wedge.

Referring now to FIG. 11, still another embodiment of the present invention is depicted, similar to the embodiment of FIGS. 7 and 10, in which media feed direction adjuster 65 is exemplified via the use of a ratchet mechanism 500.

Ratchet mechanism 500 includes a toothed member 502 having a wedge 503, a plunger 504, a plunger dog 506, a plunger return spring 508, and a toothed member return spring 510.

Toothed member 502 includes at least one tooth 512 and a cam surface 514. Toothed member 502 is movably disposed in printhead carrier 32, and cam surface 514 is coupled to printhead datum pad 35, for example, directly contacting printhead datum pad 35. Cam surface 514 is a tapered datum surface, and acts against printhead datum pad 35 in translating and aligning standard color printhead 34 with photo printhead 36. Plunger 504 is movably disposed in printhead carrier 32, and is coupled to plunger return spring 508, which is oppositely coupled to printhead carrier 32. In addition, plunger 504 is positioned on printhead carrier 32 in a location opposite flag member 109 affixed to side frame 27. Plunger dog 506 is pivotally coupled to plunger 504, and has a pawl 516 configured to engage each tooth 512 of toothed member 502.

As illustrated in FIG. 11, ratchet mechanism 500 is configured such that a movement of plunger 504 by a stroke distance 517 in a direction indicated by direction arrow 518 causes pawl 516 to engage and move toothed member 502, wherein the action of the taper of cam surface 514 acts against printhead datum pad 35 of standard color printhead 34 to thereby translate standard color printhead 34 in media feed direction 41, for example, forward feed direction 41*a*.

It will be appreciated by those skilled in the art that the taper of cam surface 514 may alternatively be configured such that the translation of standard color printhead 34 is in reverse feed direction 41*b*. Similarly, the taper of cam surface 514 may alternatively be a compound taper configured such that the translation of standard color printhead 34 is in forward feed direction 41*a* for a first number of movements of plunger 504 and then is in reverse feed direction 41*b* for a second number of movements of plunger 504, or vice-versa.

Controller 24 is configured to control the reciprocation of printhead carrier 32 based on a misalignment sensed by auto-alignment sensor 67, with the reciprocation of printhead carrier 32 acting to drive plunger 504 into flag member 109 to cause movement of plunger 504.

The method of operation of the embodiment of FIG. 11 is similar to the operation of the embodiments of FIGS. 7 and 10.

Figure 12:
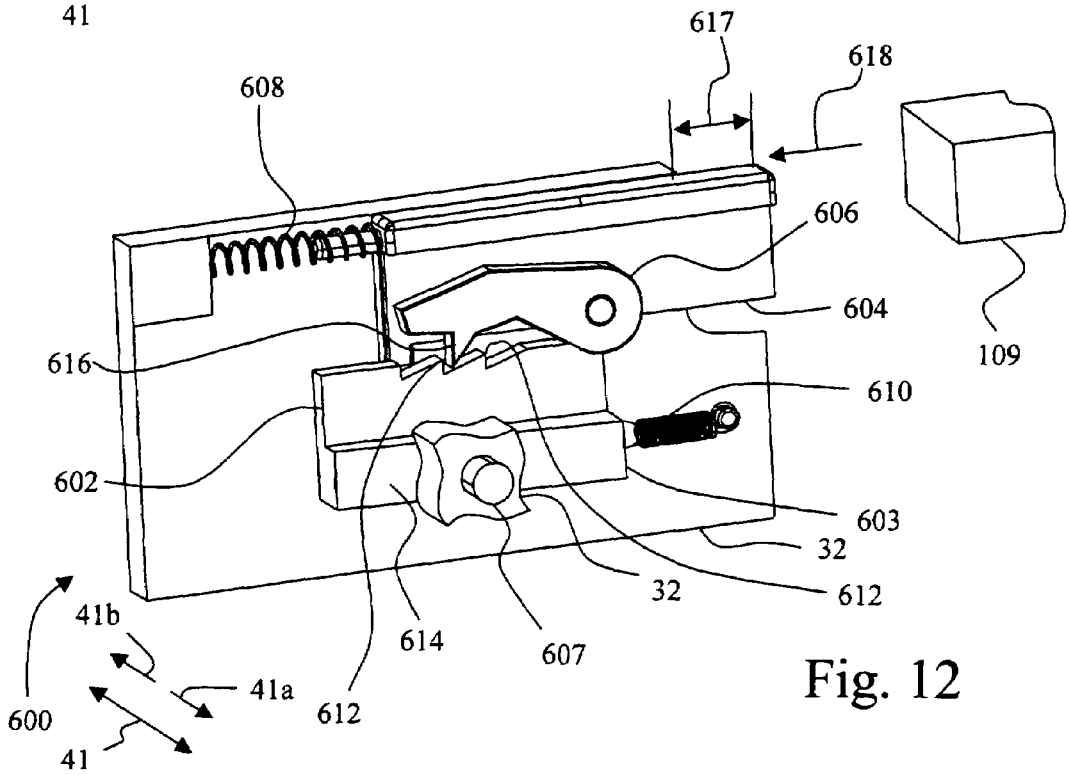
FIG. 12 depicts an embodiment of a media feed direction adjuster of the present invention exemplified by a ratchet adjuster having a toothed member including a wedge and an intermediate member in the form of an actuating pin.

Referring now to FIG. 12, still another embodiment of the present invention is depicted, similar to the embodiment of FIGS. 7, 10, and 11, in which media feed direction adjuster 65 is exemplified via the use of a ratchet mechanism 600.

Ratchet mechanism 600 includes a toothed member 602 having a wedge 603, a plunger 604, a plunger dog 606, an intermediate member in the form of an actuator pin 607, a plunger return spring 608, and a toothed member return spring 610.

Toothed member 602 includes at least one tooth 612 and a cam surface 614. Toothed member 602 is movably disposed in printhead carrier 32, and cam surface 614 is coupled to printhead datum pad 35 via actuator pin 607. In the present embodiment, actuator pin 607 directly contacts printhead datum pad 35. Cam surface 614 is a tapered datum surface, and acts against actuator pin 607, which acts against printhead datum pad 35 in translating and aligning standard color printhead 34 with photo printhead 36. Plunger 604 is movably disposed in printhead carrier 32, and is coupled to plunger return spring 608, which is oppositely coupled to printhead carrier 32. In addition, plunger 604 is positioned on printhead carrier 32 in a location opposite flag member 109 affixed to side frame 27. Plunger dog 606 is pivotally coupled to plunger 604, and has a pawl 616 configured to engage each tooth 612 of toothed member 602.

As illustrated in FIG. 11, ratchet mechanism 600 is configured such that a movement of plunger 604 by a stroke distance 617 in a direction indicated by direction avow 618 causes pawl 616 to engage and move toothed member 602, wherein the action of the taper of cam surface 614 acts against actuator pin 607, which acts against printhead datum pad 35 of standard color printhead 34 to thereby translate standard color printhead 34 in media feed direction 41, for example, forward feed direction 41*a*.

It will be appreciated by those skilled in the art that the taper of cam surface 614 may alternatively be configured such that the translation of standard color printhead 34 is in reverse feed direction 41*b*. Similarly, the taper of cam surface 614 may alternatively be a compound taper configured such that the translation of standard color printhead 34 is in forward feed direction 41*a* for a first number of movements of plunger 604 and then is in reverse feed direction 41*b* for a second number of movements of plunger 604, or vice-versa.

Controller 24 is configured to control the reciprocation of printhead carrier 32 based on a misalignment sensed by auto-alignment sensor 67, with the reciprocation of printhead carrier 32 acting to drive plunger 604 into flag member 109 to cause movement of plunger 604.

The method of operation of the embodiment of FIG. 12 is similar to the operation of the embodiments of FIGS. 7 and 10.

While this invention has been described as having a preferred design, the present invention can be further modified within the spirit and scope of this disclosure. This application is therefore intended to cover any variations, uses, or adaptations of the invention using its general principles. For example, such modifications may include employing the present invention with any two printhead cartridges, such as two color printhead cartridges or two black or mono printhead cartridges. Such modifications may also include employing the present invention with more than two printhead cartridges, for example, three or more printhead cartridges. In addition, the present invention may be employed in conjunction with existing auto alignment methods or other alignment methods including the use of multiple alignment patterns and/or selection by the user of the preferred printed alignment pattern. Further, this application is intended to cover such departures from the present disclosure as come within known or customary practice in the art to which this invention pertains and which fall within the limits of the appended claims.

What is claimed is:

1. A method for performing an alignment of a first printhead relative to a second printhead in an imaging apparatus along a media feed direction, comprising:

sensing a misalignment of said first printhead relative to said second printhead, said first printhead and said second printhead being mounted in a printhead carrier of said imaging apparatus, said printhead carrier being configured for reciprocation in a main scan direction, wherein said sensing said misalignment is performed using an auto-alignment sensor that senses a diminishing effective nozzle overlap area of a pattern generated by the first printhead and the second printhead mounted on the printhead carrier of said imaging apparatus;

determining a mechanical adjustment of a position of said first printhead relative to said second printhead based on said misalignment; and directing a user to move a lever of a media feed direction adjuster on said printhead carrier to make said mechanical adjustment based on said misalignment, wherein said mechanical adjustment translates said printhead along said media feed direction relative to said other printhead.

2. The method of claim 1, wherein an amount of said mechanical adjustment is determined based on said misalignment.

3. The method of claim 1, wherein said mechanical adjustment translates said printhead along said media feed direction in increments of less than one pel.

4. The method of claim 1, wherein said mechanical adjustment translates said printhead along said media feed direction in increments of one half pel.

* * * * *

UNITED STATES PATENT AND TRADEMARK OFFICE

CERTIFICATE OF CORRECTION

PATENT NO. : 7,661,791 B2
APPLICATION NO. : 10/881764
DATED : February 16, 2010
INVENTOR(S) : James, III et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1045 days.

Signed and Sealed this

Twenty-eighth Day of December, 2010

David J. Kappos

David J. Kappos
*Director of the United States Patent and Trademark Office*